United States Patent [19]

Michaels

[11] Patent Number: 4,945,836

[45] Date of Patent: Aug. 7, 1990

[54] RAPID EXPANSION BULLET

[76] Inventor: Daniel J. Michaels, 9641 Mark Rd., Erie, Pa. 16509

[21] Appl. No.: 399,624

[22] Filed: Aug. 28, 1989

[51] Int. Cl.[5] ..... F42B 10/34

[52] U.S. Cl. ..... 102/503; 102/507; 102/517; 102/532

[58] Field of Search ..... 102/430, 439, 501, 503, 102/507–510, 517, 532

[56] References Cited

U.S. PATENT DOCUMENTS

| | | | |
|---|---|---|---|
| 53,582 | 4/1866 | DeCowsey | 102/503 |
| 103,514 | 5/1870 | Shock | 102/501 |
| 590,428 | 9/1897 | Bennett | 102/503 |
| 1,292,388 | 1/1919 | Bowers | 102/503 |
| 2,324,551 | 7/1943 | Albree | 102/503 |
| 4,742,774 | 5/1988 | Flatau | 102/503 |
| 4,777,883 | 10/1988 | Chovich | 102/503 |

FOREIGN PATENT DOCUMENTS

| | | | |
|---|---|---|---|
| 414467 | 9/1910 | France | 102/503 |
| 1418480 | 10/1965 | France | 102/503 |

*Primary Examiner*—Harold J. Tudor
*Attorney, Agent, or Firm*—Ralph Hammar

[57] ABSTRACT

A high energy rapid expansion bullet for handguns, rifles and the like with greater killing power and protection from excessive gas pressures due to overloading of powder or obstruction in the gun barrel and without over penetration which could endanger bystanders. A standard bullet (e.g., 45 caliber, 9 MM) is provided with a through bore (draft hole) from the tip to the base of the bullet. The inner end of the bore has a conical seat spaced from the central portion of a malleable disc seal surrounded by an annular seat for the rim of the disc.

Gases generated by firing of the bullet deform the disc into contact with the conical seat and wedge the base of the bullet outward to seal the gases in the barrel of the gun and pull the rim of the disc inward to aid in separating the disc from the bullet as soon as the bullet leaves the barrel. Excessive gas pressure such as could come from overloading (too much powder), ruptures the disc and vents the gases to the atmosphere.

7 Claims, 2 Drawing Sheets

CONVENTIONAL

RAPID EXPANSION

CAL.
9mm
380

PARABELLIUM
JACKETED
OR
LEAD

CAL.
45-41
ACP

JACKETED
OR
LEAD

HP

CAL.
32
357
41
44
45

LEAD
OR
JACKETED

JHP

CAL.
223
270
308
338
45-70
AND
LARGER

OVERLOADED OR,
LODGED BULLET

PRESSURE
RELIEVED

RAPID EXPANSION BULLET

SUMMARY OF THE INVENTION

This unique small arms bullet was designed for the serious handloader, hunter, and law enforcement agencies. Also, being an excellent self-defense round.

What makes this most desirable is the fact that bullets through the years have been designed with much trial and error, to function or feed flawlessly in autoloading guns, both rifles and handguns. For example, the 9 MM Parabellum Bullet is favored for its trouble free feeding in the autoloader, but it lacks good expansion and usually over penetrates, creating less shock or stopping power, yet the round has great potential.

The Rapid Expansion Bullet in 9 MM Parabellum Design is devastating in expansion and stopping power and will still feed flawlessly because the external part of the bullet has not been changed, except for a small hole in the nose. Another example is the 45 Caliber ACP round nose or military hardball.

The Rapid Expansion Bullet turns the table on over penetration, leaving the energy mass in the target, yet contributes no problems to the feeding cycle of autoloader.

As a Law Enforcement bullet, the Rapid Expansion Bullet excels in stopping power and could save innocent people from being struck by over penetrating bullets.

To the hunter and handloader, the Rapid Expansion Bullet would mean quicker kills and less game loss.

The handloader could customize their favorite loads for extreme accuracy, expansion and penetration with little worry if ever high chamber pressure is encountered due to the built in safety valve, which vents high pressure gases out the barrel.

BACKGROUND OF THE INVENTION

The Rapid Expansion Bullet was field tested first on liquid filled containers. The results were very impressive. The Rapid Expansion Bullet in the 44 Mag Caliber pushing a 200 grain lead bullet out of a 6" barrel was seen to have the same destructive force at 25 yards as the 243 Rifle.

The Rapid Expansion Bullet was then tested on live wild boar in the State of Tennessee. These animals are heavy boned, heavy skinned, thick muscled and hard to kill. Seven of us used the 44 Mag handgun with barrel lengths ranging from 6" to 9".

The Ruger 44 Mag autoloading carbine was used to increase knowledge of kinetic energy, mass and increased velocity. Using live tissue, a one shot kill dropped the 150 pound boar in its tracks, severing the neck from the shoulder, killing it instantly. The gas operated autoloader cycled perfectly. Recoil was very light and no over pressure showed on the spent case. The bullet stayed in the target. No exit hole was found. The handguns used were all revolvers and did an outstanding job. One large boar weighing 250 pounds was shot a little high behind the front shoulder, showing a fist size hole. No exit hole was found. This revolver only had a 6" barrel; range about 10 yards. Eight boar, eight kills with no over penetration. Wounds measured 3½" diameter and over. The eight boar ranged in weight from 100 to 300 pounds. This was a limited test on hunting bullets of 44 caliber class which proved very impressive and in some cases simply awesome. These Rapid Expansion Bullets fired from a handgun seem to have the energy and devastation of the high powered Rifle.

The Rapid Expansion Bullet with its safety, simplicity and versatility in design is applicable to all caliber bullets and could revolutionize the bullet industry.

DESCRIPTION OF THE DRAWINGS

In the drawings. FIGS. 1*a* through 4*a* show conventional bullets for small arms, FIGS. 1*b* through 4*b* show the same bullets with draft holes each sealed by a malleable disc.

DETAILED DESCRIPTION OF THE INVENTION

Figure 1A:
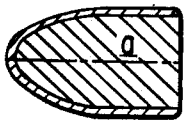
Figure 1B:
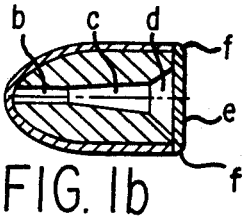
Figure 2A:
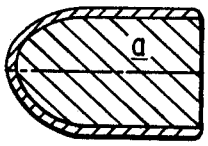
Figure 2B:
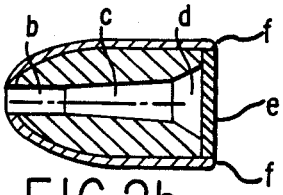
Figure 3A:
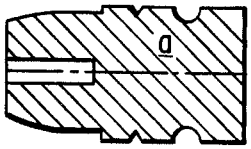
Figure 3B:
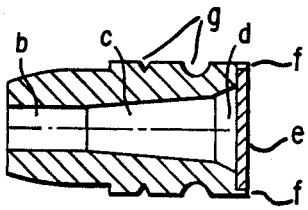
Figure 4A:
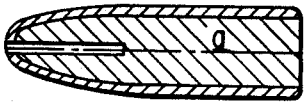
Figure 4B:
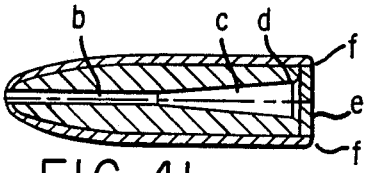

FIGS. 1*a* through 4*a* show conventional small arms bullets without draft holes. FIGS. 1*a*, 2*a*, 4*a* show bullets with jackets, FIGS. 1*b* through 4*b* show the bullets of FIGS. 1*a* through 4*a* with a central draft hole b, c, d from the nose through the base sealed at the base by a malleable or a deformable disc e sealed at rim f to the base of the bullet and having a center section spaced from section d.

Section b of the draft hole may range from 0.030" to 0.200" diameter. Section c has a shallow taper e.g., 3° to 7°. Section d has a more abrupt angle e.g., 30° to 60° providing a conical seat for the disc e. The supporting angle of the conical seat controls the amount of gas pressure the disc can handle.

The taper of the seat d allows the disc under pressure to follow that angle and change shape, which is the key for allowing the disc to break away from the bullet later on in flight. Also, it is this supporting angle that controls the amount of pressure the disc can handle.

Figure 5E:
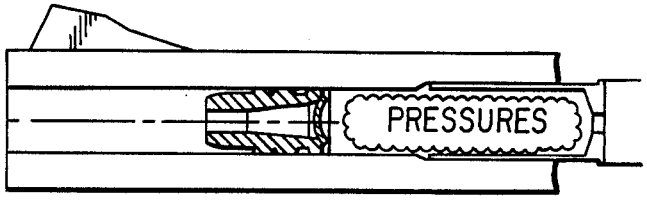
FIGS. 5*e* and 5*f* illustrate the operation under excessive pressure.
Figure 5F:
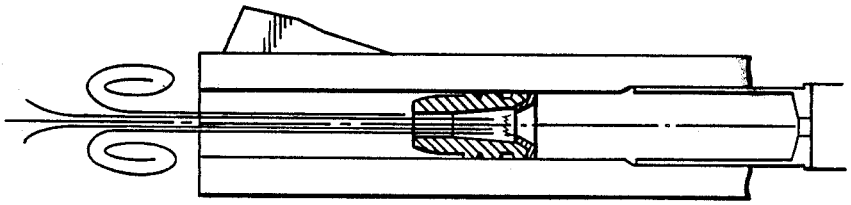
Figure 5A:
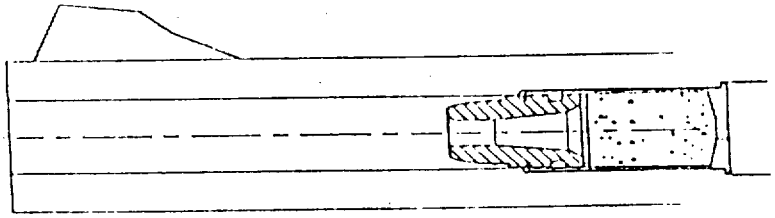
FIGS. 5*a* through 5*d* illustrate normal operation of one of the bullets.
Figure 5B:
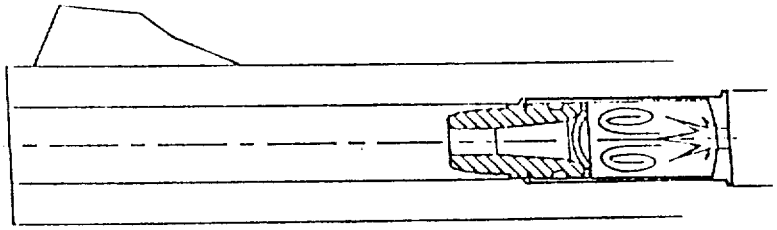
Figure 5C:
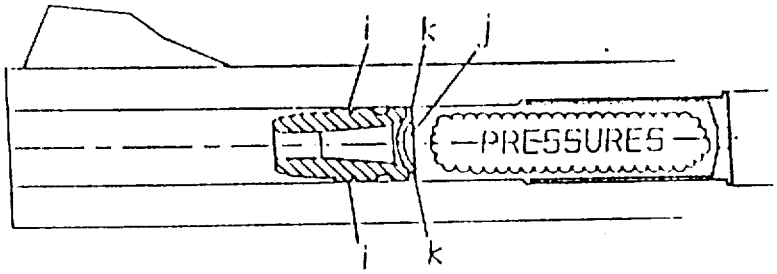
Figure 5D:
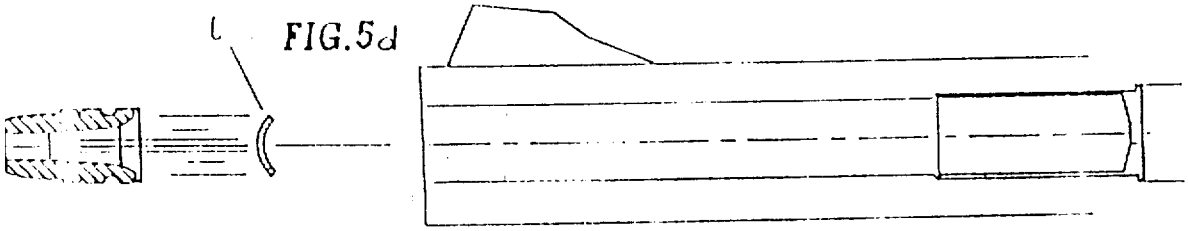

If a rupture in the disc occurs as shown in FIG. 5*f*, high pressure gases will be vented through the bullet and out the barrel; a safety factor no other bullet claims. A 90 degree angle is cut or formed at f into the base of the bullet allowing a solid aluminum disc e ranging in thickness from 0.030" to 0.080", again depending on bullet weight, diameter, and application, to be fitted snugly against the base of the bullet.

A sealant may be used at f to secure the bullet from water and other contaminents. The bullet is then lubricated at g (when non jacketed bullets are used) and seated into a powder charged and primed conventional cartridge h of proper size. Upon firing or at time of ignition, the high pressure gases push evenly at the flat disc e of the bullet ensuring good alignment. When the bearing surface of the bullet contacts the rifling i of the bore, the pressure increases and more resistance is met, the disc begins to yield and change shape as shown at j following the angled contour inside the bullet. At this point, the disc is concave in shape and smaller in diameter. As the thrust or push continues, the disc exerts pressure on the inside radius of the bullet, acting like a low profile wedge at k enlarging or expanding the outside base of the bullet, stopping any blow by gases, therefore, increasing efficiency, velocity and accuracy. Less recoil is felt due to the yielding disc, which responds somewhat like a shock absorber. When the bullet exits the barrel and pressure at the base of the bullet diminishes, the disc which is now vulnerable to the incoming stream of air from the center hole b quickly falls away as illustrated at 1.

What is claimed is:

1. A high energy bullet having a central axial bore or draft hole from the tip through the center of the base of the bullet, an annular seat on said base at right angles to the axis of said bore, an imperforate disc of malleable material having its rim seated on said annular seat and its center section axially spaced from an inclined seat on the center of the base of the bullet surrounding said bore and deformable against said inclined seat by pressure of gases generated by firing the bullet.

2. The bullet of claim 1 in which the inclined seat is conical.

3. The bullet of claim 1 in which the center section acts like a wedge wedging the inclined seat outward enlarging or expanding the base of the bullet.

4. The bullet of claim 1 in which the draft hole is of smallest area at the tip of the bullet.

5. The bullet of claim 1 in which center section of the disc is sized to rupture at excessive gas pressures and vent said excessive pressures through said draft hole.

6. A high energy bullet having a central axial bore or draft hole from the tip through the center of the base of the bullet, an imperforate deformable disc having its rim seated on the base of the bullet and its center section spaced from the draft hole and the center of the base of the bullet and deformed against the center of the base of the bullet to reduce the diameter of the rim of the disc and to seal the center section of the disc against the center of the base of the bullet by pressure of gases generated by firing of the bullet.

7. The bullet of claim 6 in which the center section of the disc is sized to rupture at excessive gas pressures and vent said excessive pressures through said draft hole.

* * * * *

UNITED STATES PATENT AND TRADEMARK OFFICE

CERTIFICATE OF CORRECTION

PATENT NO. : 4,945,836

DATED : August 7, 1990

INVENTOR(S) : Daniel J. Michaels

It is certified that error appears in the above-identified patent and that said Letters Patent is hereby corrected as shown below:

Title Page - Under "Abstract" -

"7 Claims, 2 Drawing Sheets" should read -- 7 Claims, 3 Drawing Sheets --

Sheet 1 of the Drawings now titled "Sheet 1 of 2" should read -- Sheet 1 of 3 --

A new sheet should be printed titled "Sheet 2 of 3" and containing Figs. 5a, 5b, 5c, 5d.

Sheet 2 of the drawings containing Figs. 5e and 5f now titled

UNITED STATES PATENT AND TRADEMARK OFFICE

CERTIFICATE OF CORRECTION

PATENT NO. : 4,945,836

DATED : August 7, 1990

INVENTOR(S) : Daniel J. Michaels

It is certified that error appears in the above-identified patent and that said Letters Patent is hereby corrected as shown below:

"Sheet 2 of 2" should read -- Sheet 3 of 3--

Signed and Sealed this

Tenth Day of September, 1991

*Attest:*

HARRY F. MANBECK, JR.

*Attesting Officer*

*Commissioner of Patents and Trademarks*

STEP 1

STEP 2

STEP 3